US008578513B2

(12) United States Patent
Carlson et al.

(10) Patent No.: US 8,578,513 B2
(45) Date of Patent: Nov. 12, 2013

(54) DELTOID ARM PROTECTION SYSTEM FOR BALLISTIC BODY ARMOR

(75) Inventors: Richard A. Carlson, Chino Hills, CA (US); Jesse B. Thompson, North Bend, WA (US)

(73) Assignee: Safariland, LLC, Jacksonville, FL (US)

( * ) Notice: Subject to any disclaimer, the term of this patent is extended or adjusted under 35 U.S.C. 154(b) by 2175 days.

(21) Appl. No.: 11/199,860

(22) Filed: Aug. 8, 2005

(65) Prior Publication Data

US 2007/0028339 A1 Feb. 8, 2007

(51) Int. Cl.
*A41D 13/00* (2006.01)

(52) U.S. Cl.
USPC ..... 2/2.5

(58) Field of Classification Search
USPC ..... 2/2.5, 102, 94, 96, 97, 464, 467; 89/36.01, 36.02, 36.05, 911
See application file for complete search history.

(56) References Cited

U.S. PATENT DOCUMENTS

| | | | | | |
|---|---|---|---|---|---|
| 2,755,475 | A | * | 7/1956 | Lipshitz | 2/2.5 |
| 3,514,786 | A | * | 6/1970 | Terwilliger | 2/2.5 |
| 4,425,667 | A | * | 1/1984 | Harrison | 2/462 |
| 4,467,476 | A | | 8/1984 | Herbert | |
| 4,485,492 | A | * | 12/1984 | Sneider | 2/56 |
| 4,497,069 | A | * | 2/1985 | Braunhut | 2/2.5 |
| 4,993,076 | A | * | 2/1991 | Dierickx | 2/463 |
| 5,044,011 | A | * | 9/1991 | Henderson | 2/2.5 |
| 5,060,314 | A | | 10/1991 | Lewis | |
| 5,495,620 | A | * | 3/1996 | Schoenweiss et al. | 2/2.5 |
| 5,590,826 | A | | 1/1997 | Endo | |
| 5,623,729 | A | * | 4/1997 | Chen | 2/461 |
| 5,966,747 | A | * | 10/1999 | Crupi et al. | 2/466 |
| 5,970,513 | A | * | 10/1999 | Kocher | 2/2.5 |
| 6,026,510 | A | | 2/2000 | Kocher | |
| 6,029,270 | A | * | 2/2000 | Ost et al. | 2/2.5 |
| 6,098,196 | A | * | 8/2000 | Logan | 2/2.5 |
| 6,108,813 | A | * | 8/2000 | Tolliver et al. | 2/2.5 |
| 6,446,273 | B1 | * | 9/2002 | Gillen et al. | 2/455 |
| 6,453,791 | B1 | * | 9/2002 | Seitzinger | 89/36.05 |
| 6,485,446 | B1 | | 11/2002 | Brother et al. | |
| 6,698,024 | B2 | | 3/2004 | Graves et al. | |
| 6,745,394 | B1 | | 6/2004 | Rutherford | |
| 6,892,392 | B2 | | 5/2005 | Crye et al. | |
| 7,506,384 | B2 | * | 3/2009 | Ide et al. | 2/459 |

FOREIGN PATENT DOCUMENTS

DE 4214543 A1 11/1993

* cited by examiner

*Primary Examiner* — Tejash Patel
(74) *Attorney, Agent, or Firm* — Kane Kessler, P.C.; Paul E. Szabo

(57) ABSTRACT

A deltoid arm protection system for a ballistic vest including an asymmetrical anatomically shaped deltoid cover having fasteners for attachment to a ballistic vest. The deltoid cover is connected to the vest and prevents any gaps forming between the deltoid cover and the vest during arm movement of the wearer. The deltoid cover includes a weapon gripping pad and attachment loops on an outer surface of the deltoid cover.

14 Claims, 1 Drawing Sheet

10
12
14
16
18
20
21
22
24
26
28
30
32
34
36
38
40
42
44
46
48
50

DELTOID ARM PROTECTION SYSTEM FOR BALLISTIC BODY ARMOR

FIELD OF THE INVENTION

This invention relates to protective vests, and more particularly, to body armor commonly known as a ballistic vest, which incorporates a deltoid arm protection system attachable to the ballistic vest.

BACKGROUND OF THE INVENTION

Ballistic vests have been in use for many years and have saved the lives of military personnel and law enforcement officers. As a result, the military and law enforcement agencies have made it mandatory for soldiers and officers to wear a ballistic vest while on duty.

Ballistic vests have been available in recent years as a protective panel having overlying layers of a fabric made from woven high tensile strength fibers. Woven fabrics from an aramid fiber known as Kevlar, for example, have been used successfully in ballistic vests because of the high energy absorption properties of the fabric material. The material is also reasonably light in weight and flexible, which provides improved comfort when compared with previous vests which were made of metal and were therefore heavier and more rigid. The comfort of a ballistic vest is extremely important, especially to soldiers and law enforcement officers, because of the heat build-up that occurs from wearing a heavy and inflexible vest for the long hours in use. Resistance to projectile penetration is a principle factor in designing a ballistic vest; and added protective layers can offer greater protection against projectiles having the higher threat levels, but added protective layers also add undesired weight and inflexibility of the vest.

In addition to woven Kevlar fabric layers, ballistic vests have been made from other high strength fibers and composites to reduce weight and improve flexibility of the vest. However, ballistic vests using the lighter, more flexible materials also must offer the required minimum levels of protection against penetration by different types of projectiles. The more flexible the ballistic fabrics are, the more bunching and backface deformation occurs upon impact from a projectile. A vest must not be too flexible where is cannot protect the wearer.

Ballistic vests are regularly certified by subjecting them to ballistics testing to measure their ability to protect against different projectiles fired from different types of weapons at various angles. One ballistic test commonly used in the industry is the National Institute of Justice (NIJ) Standard 0101.03 Threat Level IIIA, which, in general terms, is a high performance standard requiring that the ballistic vest prevent penetration of specified 0.44 Magnum and 9 mm rounds fired at a velocity of at least 1400 ft/sec. In addition to prevent such projectile penetration, "backface deformation" also is a required test factor in the NIJ Standard 0101.03 Threat Level IIIA certification test. Backface deformation measures the trauma level experienced by a projectile that does not penetrate the test panel. According to this test, the maximum allowable backface signature (bfs) containment for soft body armor requires a maximum allowable bfs of 44 mm for 0.44 Magnum and 9 mm rounds.

A problem associated with currently available ballistic vests is the inability to protect the wearer from projectiles entering the body through the upper arm or deltoid area or armpit. Considering a vest does not protect the upper arms/armpit area, the wearer is vulnerable to projectiles, particularly from snipers. This specific problem has tried to be addressed by incorporating a ballistic device to be worn around the bicep of the user. This bicep device was designed to also cover the deltoid area of the wearer. The bicep device has proven to be ineffective at stopping projectiles from entering the body through the armpit area in all instances because when a wearer moves their arms they expose the armpit. Arm movement prevents the bicep device from protecting this area at all times. Previous bicep devices also create excessive heat build-up for the wearer.

Consequently, a need exists for an improved vest design which addresses the drawbacks of previous vest designs, namely, to provide a deltoid arm protection system which provides protection at all times and reduces heat build-up for the wearer.

SUMMARY OF THE INVENTION

The present invention provides a deltoid arm protection system for a ballistic vest. The ballistic vest preferably comprises a plurality of overlying first flexible layers arranged in a stack on a strike side of the vest, and a plurality of overlying second flexible layers arranged in a stack on a body side of the vest. Preferably, each first flexible layer comprises a thin, flexible, woven fabric layer made of high tensile strength polymeric fibers. The individual woven fabric layers form a soft, flexible woven fabric first panel for the vest. Preferably, each second flexible layer comprises a thin, flexible imperforate fiber-reinforced plastic sheet comprising an array of plastic fibers embedded in a thermoplastic resinous matrix that forms each film sheet. The second layers overlie each other and as a combination are referred to as a second panel of the vest. The first and second panels are both located in the front and rear of the vest. Although this is a preferred ballistics package, any type and number of ballistic packages which meet any threat level are contemplated for use in the present invention. The vest of the present invention preferably is worn on the outside of the wearers' clothing or uniforms and is commonly referred to as an outer tactical vest or OTV.

The ballistic vest of the present invention incorporates fasteners to fasten the front panel to the back panel, such as hook and loop fasteners, buckles, zippers and other fastening systems.

More particularly, the deltoid arm protection system of the present invention incorporates a deltoid cover for each shoulder area made of a ballistic package similar to the ballistic vest, which is attached to the ballistic vest to protect the deltoid/armpit area of the wearer. The deltoid cover is directly attached to the ballistic vest by loops and straps. The deltoid cover is fixed with respect to the vest and is not attached to the arm of the wearer so when the arm moves no gaps are created which would be susceptible to a projectile. The deltoid cover is contoured to allow arm movement without being hindered. The deltoid cover is designed so that it articulates under the back of the vest so that it does not bind with backpacks, etc. The deltoid cover also includes a weapon pad on its outer surface for positive engagement of the end of the weapon. Additional hooks/loops/straps also can be located on its outer surface for the attachment of accessories. Optionally, a bicep cover also is incorporated into the system for further protection of the bicep area of the arm.

BRIEF DESCRIPTION OF THE DRAWINGS

These and other features and advantages of the present invention will be more fully understood by reference to the drawings and following detailed description wherein.

DETAILED DESCRIPTION OF THE INVENTION

Figures 1, 2, 3, 4, 5:
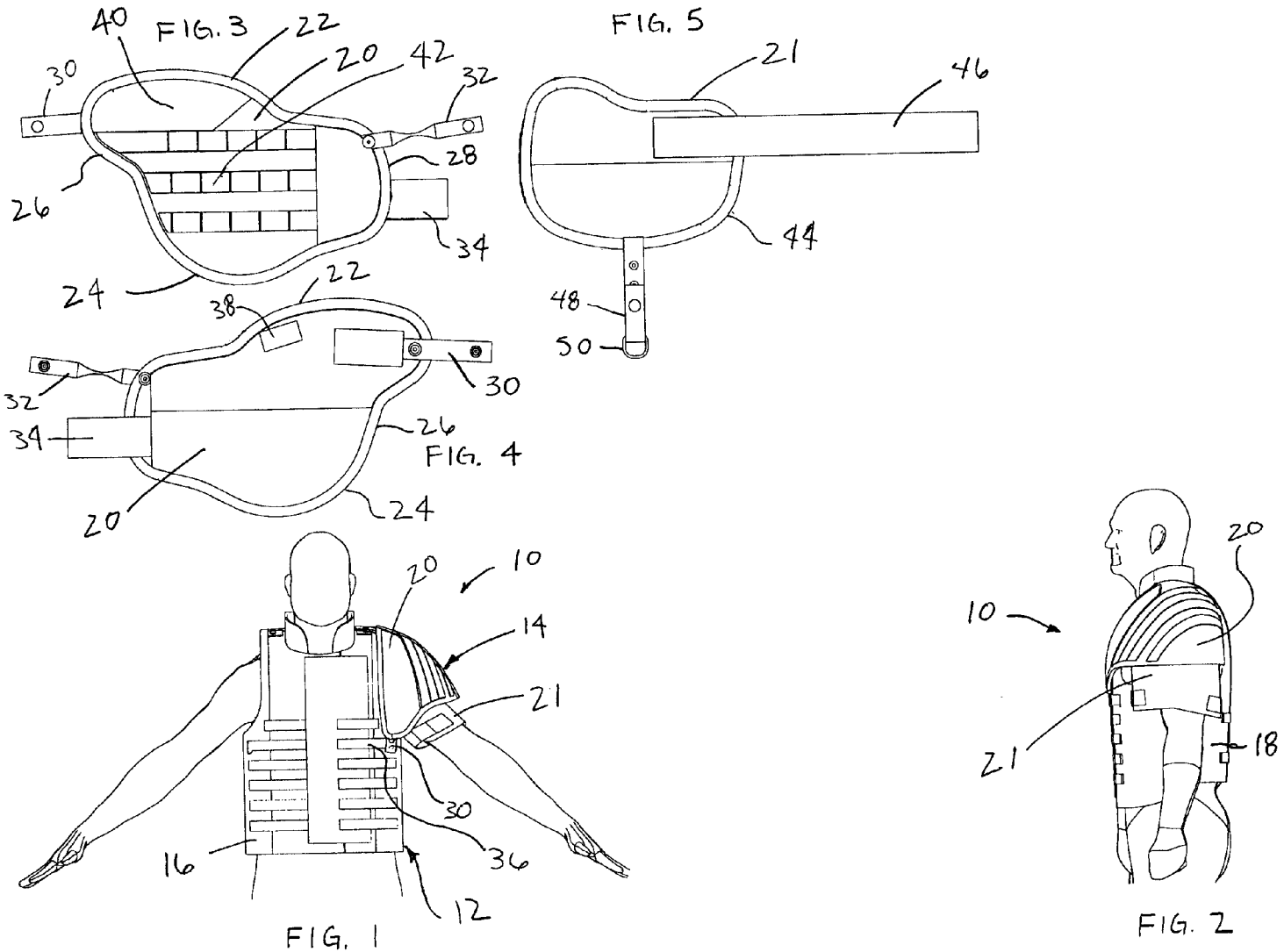
FIG. 1 is a front view of a ballistic vest incorporating the deltoid arm protection system of the present invention.
FIG. 2 is a side view of the ballistic vest of FIG. 1.
FIG. 3 is a front view of the deltoid cover of the present invention.
FIG. 4 is a back view of the deltoid cover of FIG. 3; and illustrating the access to the ballistics penal or package.
FIG. 5 is a front view of an optional bicep cover for the protection system of the present invention.

A ballistic vest system 10 of the present invention is shown in FIGS. 1 and 2. The ballistic vest system 10 is an outer tactical vest 12 commonly worn by military and law enforcement officers and includes a deltoid arm protection system 14. The ballistic vest includes a front panel 16 and a rear panel 18. The front panel 16 protects the chest and stomach of the wearer while the rear panel 18 protects the back of the wearer. Both the front and rear panels protect the sides of the wearer. Contained within the front and rear panels is a ballistic package which comprises individual layers of ballistic material located within a covering layer as commonly known. The deltoid arm protection system 14 includes a deltoid cover 20 and an optional bicep cover 21. Although FIGS. 1 and 2 illustrate only one deltoid cover 20 and bicep cover 21, it is to be understood that they are located on both sides of the vest.

As also can be seen in FIGS. 3 and 4 the deltoid cover 20 has a composite shape having a contoured inside edge surface 22, contoured outside edge surface 24, contoured front edge surface 26 and a contoured rear edge surface 28. The overall shape and configuration of the deltoid cover 20 was designed with composite draping so that it covers the entire deltoid region of the body throughout its range of movement without exposing the deltoid/armpit area during any range of motion. The deltoid cover was also designed to be retrofit into existing vests without modification and includes a front fastener 30, a rear fastener 32 and rear fastener 34. Fastener 30 can be an elastic front strap which can be connected to a loop 36 positioned on the front panel 16 of the est. Likewise, fastener 32 is a back elastic strap for connection to a loop on the rear panel 18 of the vest. Fastener 34 also can be an elastic strap for connection to a loop on the vest. The deltoid cover also can include a loop 38 for attachment to a strap on the vest. The fasteners can include snaps, Velcro, buttons, etc. for rigid connection to the vest.

The back edge contour 28 is shaped so that it can be positioned under and articulate under the vest so that it does not bind with a backpack or other gear typically worn by military or police officers. Also positioned on the front surface of the deltoid cover is a rubberized weapon pad 40 which provides a positive engagement for the butt of a rifle to steady the weapon during firing. Any rubberized material, such as neoprene, can be used to provide the necessary friction between the butt of the gun and the pad for this purpose. Also positioned on the outer surface of the deltoid cover can be loops, hooks or straps, collectively referred to as reference numeral 42 for the attachment of additional accessories, such as canteens, first-aid pouches, ammunition clips, etc. used by military and police officers.

Referring now to FIG. 5 the deltoid arm protection system can also include the optional bicep pad 21. Bicep pad 21 also includes a contoured edge surface 44 extending around the cover to totally protect the bicep area of the arm. The bicep pad 21 is affixed around the bicep of the wearer by an elastic armband 46 attached to the bicep cover. The bicep cover also includes an elastic hang loop 48 having a D-ring 50 for attachment to the system.

The deltoid arm protection of the present invention is designed to stop projectiles from entering the side of the vest in the shoulder area and has been designed to have an asymmetrical anatomical shape which is contoured to allow movement of the arm without hindrance. The attachment system is designed so that the deltoid cover is fixed to the vest so that no gaps are created in the shoulder/armpit area during arm movement. The deltoid cover has also been designed so that it articulates in the back of the vest underneath the vest to prevent interference with additional accessories. The deltoid cover and bicep cover can be made of soft or hard armor pieces, or semi-rigid armor components. The weapon gripping area on the front of the deltoid cover has a molded three-dimensional surface to provide a friction grip for a rifle.

Although the present invention has been shown and illustrated with respect to an embodiment thereof, the invention is not to be so limited since changes and modifications can be made therein which are within the scope of the invention as hereinafter claimed.

The invention claimed is:

1. A deltoid arm protection system for a ballistic vest comprising: an asymmetrical anatomically shaped deltoid cover located on either side of the ballistic vest; fasteners for attaching the deltoid cover to the vest; and a weapon gripping pad on an outer surface of the deltoid cover.

2. The deltoid arm protection system of claim 1 wherein the deltoid cover has a rear contour to provide articulation of the deltoid cover underneath the ballistic vest.

3. The deltoid arm protection system of claim 1 wherein the system further includes a bicep cover attachable to each deltoid cover.

4. The deltoid arm protection system of claim 1 wherein the fasteners of the deltoid cover are elastic straps.

5. The deltoid arm protection system of claim 1 wherein the fasteners are loops.

6. The deltoid arm protection system of claim 1 wherein the deltoid cover has attachment loops positioned on an outer surface of the deltoid cover.

7. The deltoid arm protection system of claim 1 wherein the fasteners are located on opposite end locations of the deltoid cover.

8. A ballistic vest comprising: a front panel; a rear panel; and at least one deltoid cover having fasteners to attach the deltoid cover to at least the front panel of the ballistic vest whereby no gaps are created between the ballistic vest and the deltoid cover during arm movement of a wearer; wherein the deltoid cover has an asymmetrical anatomical shape.

9. A ballistic vest comprising: a front panel; a rear panel; and at least one deltoid cover having fasteners to attach the deltoid cover to at least the front panel of the ballistic vest whereby no gaps are created between the ballistic vest and the deltoid cover during arm movement of a wearer; wherein the deltoid cover has a rear contour to provide articulation of the deltoid cover underneath the rear panel.

10. A ballistic vest comprising: a front panel; a rear panel; and at least one deltoid cover having fasteners to attach the deltoid cover to at least the front panel of the ballistic vest whereby no gaps are created between the ballistic vest and the deltoid cover during arm movement of a wearer; wherein the deltoid cover has a weapon gripping pad on an outer surface.

11. A ballistic vest comprising: a front panel; a rear panel; and at least one deltoid cover having fasteners to attach the deltoid cover to at least the front panel of the ballistic vest whereby no gaps are created between the ballistic vest and the deltoid cover during arm movement of a wearer; wherein the deltoid cover has attachment loops on an outer surface.

12. A ballistic vest comprising: a front panel; a rear panel; and at least one deltoid cover having fasteners to attach the deltoid cover to at least the front panel of the ballistic vest whereby no gaps are created between the ballistic vest and the deltoid cover during arm movement of a wearer; wherein the deltoid cover further includes means to attach the deltoid cover to the rear panel.

13. A ballistic vest comprising a front panel; a rear panel; and means for protecting a deltoid area of a wearer of the ballistic vest which is attached to the ballistic vest so as to remain substantially stationary during shoulder and arm movement by the wearer; wherein the means for protecting the deltoid area of the wearer is a deltoid cover having fasteners for attaching to the ballistic vest; and wherein the deltoid cover includes a weapon gripping pad on an outer surface of the deltoid cover.

14. A ballistic vest comprising a front panel; a rear panel; and means for protecting a deltoid area of a wearer of the ballistic vest which is attached to the ballistic vest so as to remain substantially stationary during shoulder and arm movement by the wearer; wherein the means for protecting the deltoid area of the wearer is a deltoid cover having fasteners for attaching to the ballistic vest; and wherein the deltoid cover includes attachment loops on an outer surface of the deltoid cover.

* * * * *